US005895291A

United States Patent [19]

Furio et al.

[11] Patent Number: 5,895,291

[45] Date of Patent: Apr. 20, 1999

[54] SHIELDED CABLE CONNECTOR ASSEMBLY

[75] Inventors: Miguel Furio, Chaville; Gilles Loudieux, Mantes La Jolie, both of France

[73] Assignee: The Whitaker Corporation, Wilmington, Del.

[21] Appl. No.: 08/735,627

[22] Filed: Oct. 23, 1996

[30] Foreign Application Priority Data

Nov. 2, 1995 [FR] France ..... 95 12936
Apr. 18, 1996 [EP] European Pat. Off. ..... 96400835

[51] Int. Cl.[6] ..... H01R 9/03
[52] U.S. Cl. ..... 439/610
[58] Field of Search ..... 439/583, 584, 439/607, 608, 609, 610, 98, 99, 101, 905

[56] References Cited

U.S. PATENT DOCUMENTS 4,173,386 11/1979 Kauffman et al. ..... 339/117 R
5,409,400 4/1995 Davis ..... 439/610

*Primary Examiner*—Gary F. Paumen
*Assistant Examiner*—Yong Ki Kim
*Attorney, Agent, or Firm*—Driscoll Nina

[57] ABSTRACT

A shielded cable connector comprises a terminal section and a cable section. The cable section comprises support shells mountable over shielding of the cable, and clamping half-shells that have ends engageable in grooves of the support members. The clamping half-shells are pivotable together to clamp a shielding braid that is reversely folded over a cylindrical portion of the support members. A retention ring is passed over the clamping half-shells to securely lock them to the terminal section. Assembly of the shield clamping portions is thus enabled after the terminals are mounted in the connector for a more cost-effective assembly procedure.

15 Claims, 9 Drawing Sheets

(PRIOR ART) FIG. 1

SHIELDED CABLE CONNECTOR ASSEMBLY

BACKGROUND OF THE INVENTION

1. Field of the Invention

This invention relates to a connector assembly for mounting on a shielded cable.

2. Description of the Prior Art

In certain applications, such as in the aerospace industry, there are stringent requirements on the robustness, reliability, and shielding effectiveness of cable connectors. A typical cable outlet of a connector for demanding applications in the aerospace industry is shown in FIG. 1. The outlet of FIG. 1 comprises a body 4' extending from a cable receiving end 6' to a mating end 8', the body comprising an outer shell 10' and a coupling nut 12' at the mating end 8' for secure mechanical coupling to the body of the connector (not shown). A shielded cable 3' comprising a plurality of conductors 5' are surrounded by a shielding braid 7' which is enclosed by an insulating jacket 9'. Electrical terminals 14' of the connector are crimpable to ends of the conducting wires 5'. A collar 16' is mountable over a cable receiving end portion of the outer shell 10' for clamping the shielding braid 7' thereto. Assembly of the cable outlet of FIG. 1 is effected by first preparing the end of the cable 3', and passing the conducting wires 5' into the cavity of the body 4'. The terminals 14' can then be crimped to conducting strands of the conducting wires 5', the terminals subsequently being inserted into cavities of an insulative housing of the connector (not shown). The cable outlet body can then be securely attached to the connector by means of the coupling nut 12'. The subsequent step is to mount the shielding braids 7' over the cable receiving end 6' of the outlet body. The collar 16' is then slipped over the shielding braid and cable receiving end of the body, and securely attached thereto by a threaded portion 18' engaging the body for securely clamping the shielding braid thereto. The latter provides both mechanical strain relief means for the cable, and an effective shielding continuity between the cable shielding and the connector.

Although this known connector is robust and reliable, it is relatively expensive to produce, particularly because of the assembly costs. A major disadvantage in the assembly arises from the need to mount the outer shell 10' over the cable 3' prior to connection of the terminals 14' to the conducting wires 5'. This assembly procedure requires hand assembly of the terminals to the conducting wires 5'. Another problem may arise from stretching the shielding braid over the end of the connector outer shell, as air spaces in the braid enlarge, and are relatively exposed to the environment, thereby reducing shielding effectiveness and reliability.

It would therefore be desirable to provide a robust, reliable and effective shielded connector that is nevertheless cost-effective to produce, and in particular cost-effective to assemble.

SUMMARY OF THE INVENTION

An object of this invention is to provide a robust, reliable connector for shielded cable that is cost-effective to produce, and in particular to assemble.

It is a further object of this invention to provide an easy to assemble connector for a shielded cable, that has an effective strain relief means and effective electrical shielding interconnection between the cable and the connector.

Objects of this invention have been achieved by providing a connector for connection to a shielded cable, the connector comprising a terminal section for assembly of terminals therein, and a cable section for clamping and electrical connection to shielding of the cable, the cable section comprising a support having a body portion mountable around the cable such that shielding thereof can be clamped thereto, characterized in that the support comprises at least two separate parts that enable mounting to the cable without feeding the cable through the support.

Advantageously, the means for contacting the shield can be mounted to the cable after termination of the cable to contacts, thereby reducing assembly costs.

Objects of this invention have also been achieved by providing a connector comprising a terminal receiving section and a cable receiving section, the terminal receiving section having an outer housing with an inner cavity for receiving an insulative housing and electrical terminals mounted therein for connection to conducting wires of a shielded cable, the cable receiving section securely mountable to a cable receiving end of the terminal receiving portion and comprising a shielding braid support over which is mountable clamping shells for clamping the shielding braid between the support and the shells, further comprising a mounting ring for securing the clamping shells to the terminal receiving section. Advantageously, not only is good electrical connection ensured between the shielding of the cable and the connector by means of the clamping shells, but as the clamping shells are separate parts that can be mounted around the cable after assembly of the terminal section, a cost-effective assembly procedure is enabled. The shielding braid support may also comprise a plurality of parts mountable over the cable after assembly of the terminal receiving section to the cable. Provision of a pivot support recess at an end of the shielding braid support, within which ends of the clamping shells can be inserted, could provide a shoulder for pivotally biasing the clamping shells into clamping engagement with the support, thereby squeezing the shielding braid tightly therebetween. At a terminal section end of the clamping shells, provision of axial projections that interengage with projections of the terminal receiving section prevent rotation of the cable section with respect to the terminal receiving section, in particular when mounting the two sections together.

Further advantageous aspects of the invention will be apparent from the claims and following description.

DETAILED DESCRIPTION OF THE PREFERRED EMBODIMENT

Figure 1:
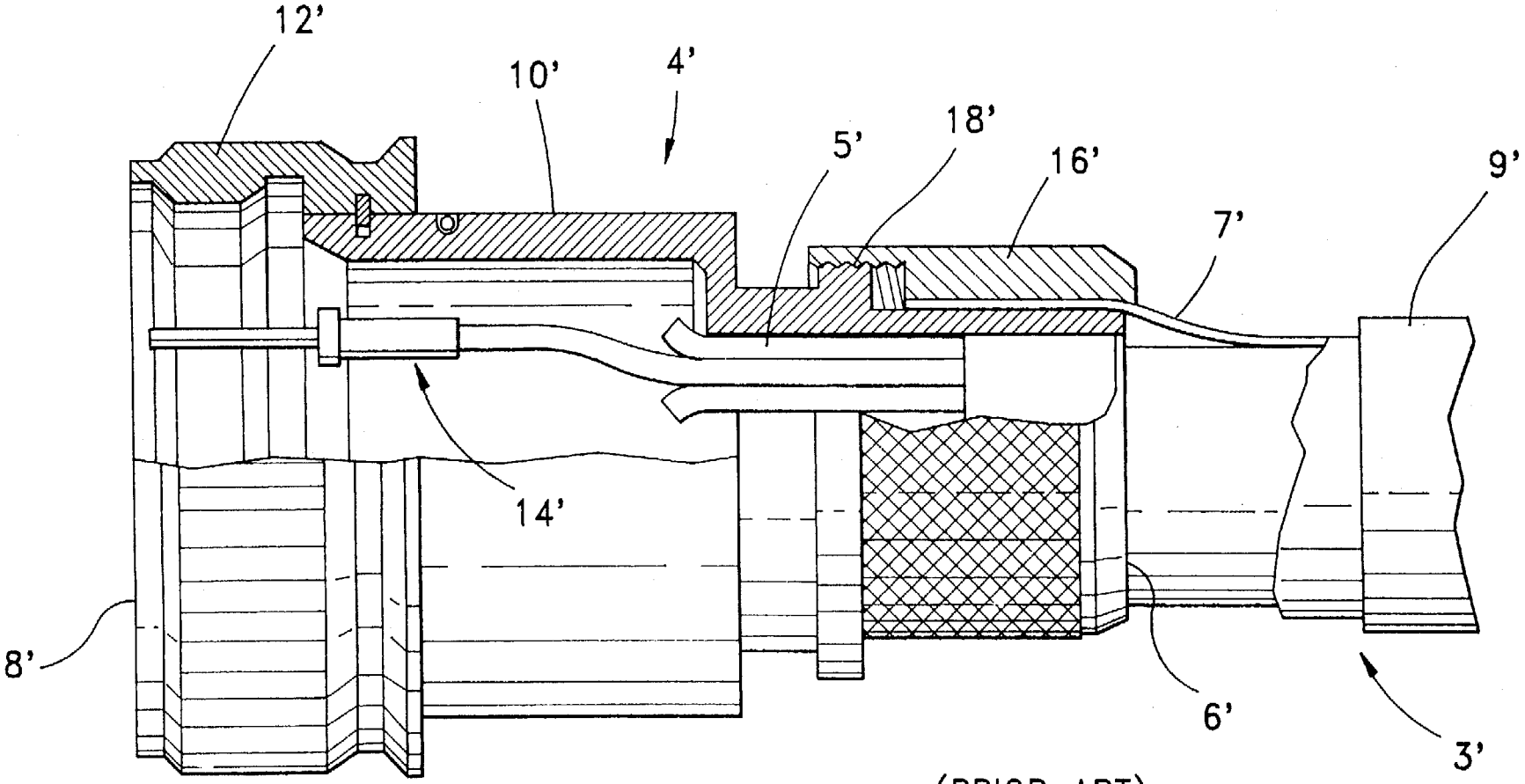
FIG. 1 is a partial cross-sectional view of a conventional connector assembly mounted to a shielded cable.
Figure 2:
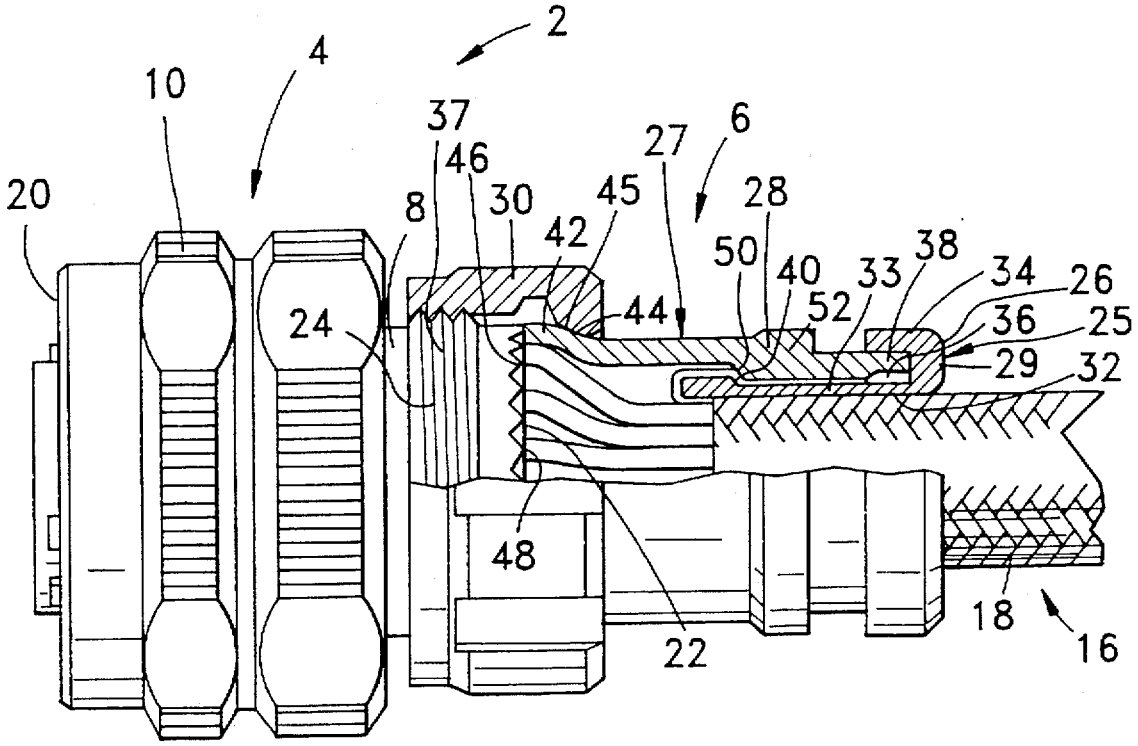
FIG. 2 is a partial cross-sectional view of a connector assembly mounted to a shielded cable, according to this invention.

Referring to FIG. 2, a shielded cable connector 2 comprises a terminal section 4 and a cable section 6. The terminal section 4 comprises an outer housing 8 made of a conducting material (such as metal) or a insulating material plated with conductive material for shielding, and a locking ring 10 rotatably mounted on the outer housing 8 for screw or bayonet type connection to a complementary locking portion of a mating connector (not shown). Within the outer housing 8 is mounted an insulative housing with cavities extending therethrough for receiving terminals 12 (see FIG. 3). The terminals 12 are crimpable to conducting strands of individual wires 14 of a cable 16 (see FIGS. 2 and 3). The cable 16 further has a conductive braid 18 surrounding the plurality of wires 14 for shielding thereof. The terminal portion 4 of the connector extends between a mating end 20 and a cable receiving end 22. At the cable receiving end 22 is a threaded portion 24 for engagement with a retention ring 30.

The cable section 6 comprises a shield support 25, a shield clamp 27 and the retention ring 30. The shield support 25 comprises a pair of support members 26 that form a generally cylindrical structure having a cavity 32 extending therethrough adapted for receiving the outer diameter of the cable 16 with shielding braid, the support further having an annular shoulder 34 separated via an end wall 29 from a main cylindrical body portion 33 by an annular slot 36 for receiving a pivot support end 38 of a pair of clamping members 28 of the shield clamp 27. At a forward end of the cylindrical portion 33 is a conical abutment surface 40 facing rearwardly. The clamping members 28 extend from the pivot end 38 to a terminal section end 42 that has an outward retention shoulder 44 facing rearwardly and a plurality of axially directed projections 46 that engage with complementary projections 48 of the terminal section cable receiving end 22 for preventing relative rotation of the clamping members 28 and terminal section. The outward retention shoulder 44 engages with a complementary shoulder 45 of the retention ring 30 for securely locking the clamping members 28 to the terminal section 4, whereby the retention ring 30 has a threaded inner surface for engaging the thread 34 of the terminal section.

Figure 11:
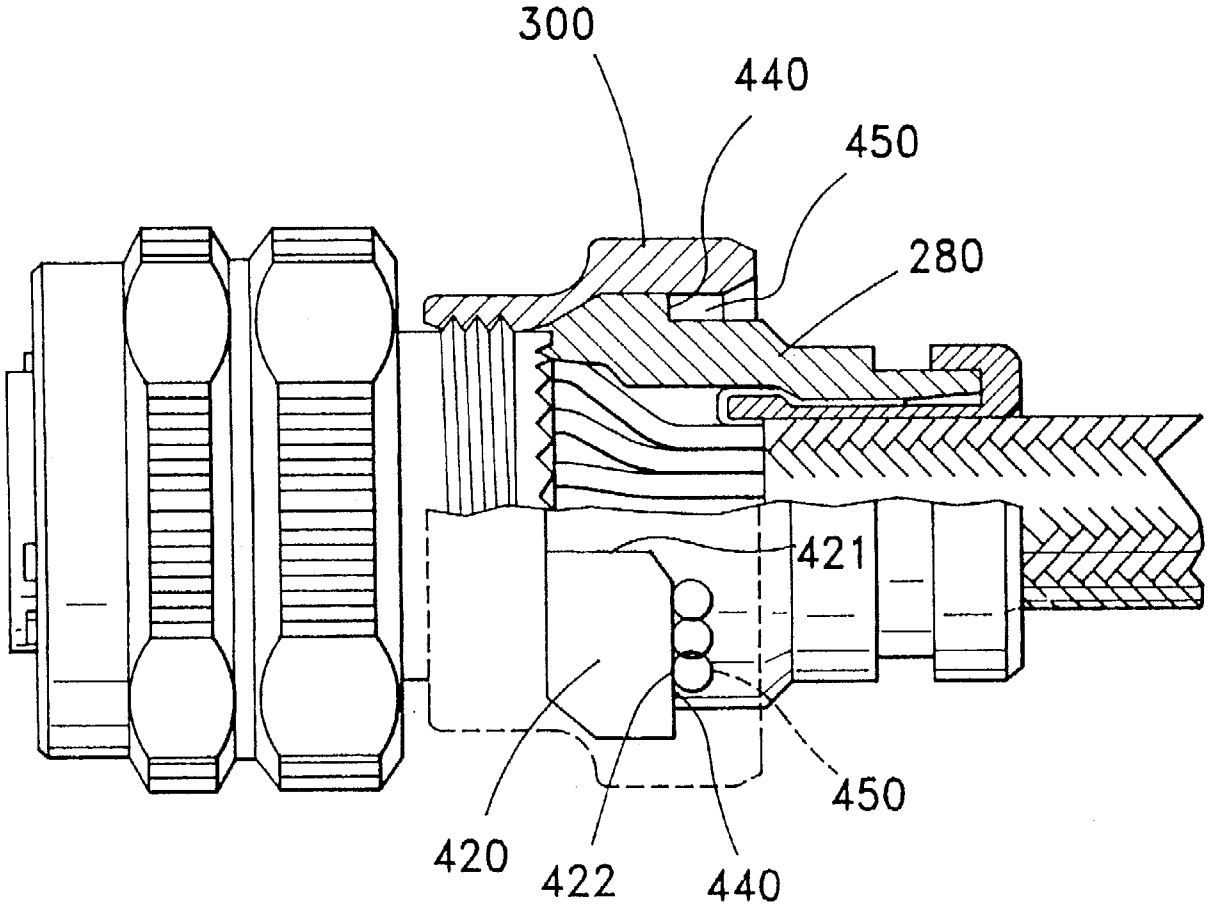
FIG. 11 is a partial cross-sectional view of yet another embodiment of this invention having a "bayonet" type of retention ring.
Figure 12:
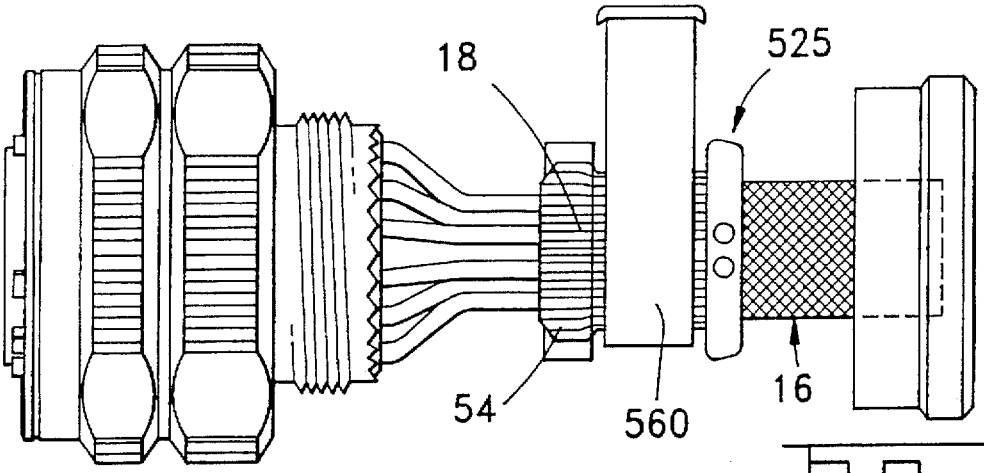
FIG. 12 is a side view of another embodiment according to this invention, in a partially disassembled state.

Referring to FIG. 11, another embodiment of a locking ring 300 comprises a complementary shoulder 450 in the shape of a cylindrical projection, or a plurality of discrete projections disposed around the circumference that engage against a retention shoulder 440 of the clamping shells 280. A terminal section end 420 of the clamping shells 280 has axial grooves 421 that allow passage of the projections 450. The clamping shells can thus be quickly mounted to the connector and retention ring 300, by axial insertion of the clamping shells into the retention ring such that the projections 450 slide through the grooves 421, subsequently rotating the retention ring such that the projections 450 ride along the retention shoulder 440 of the clamping shells. The retention shoulder is slightly tapered to effect an axial tightening of the clamping shells against the connector. Dimples 422 along the retention shoulder 440 provide a seating for retaining the cylindrical projections in their angular end position with respect to the clamping shells 280. A rapid attachment of the clamping shells to the connector assembly is thus achieved with this embodiment.

Referring again to FIG. 2, the clamping members 28 have a complementary conical abutment surface 50 to the conical abutment surface 40 of the support members 26 and extending rearwardly therefrom a cylindrical clamping surface for clamping the shielding braid against the cylindrical portion 33 of the support member 26.

Figure 3:
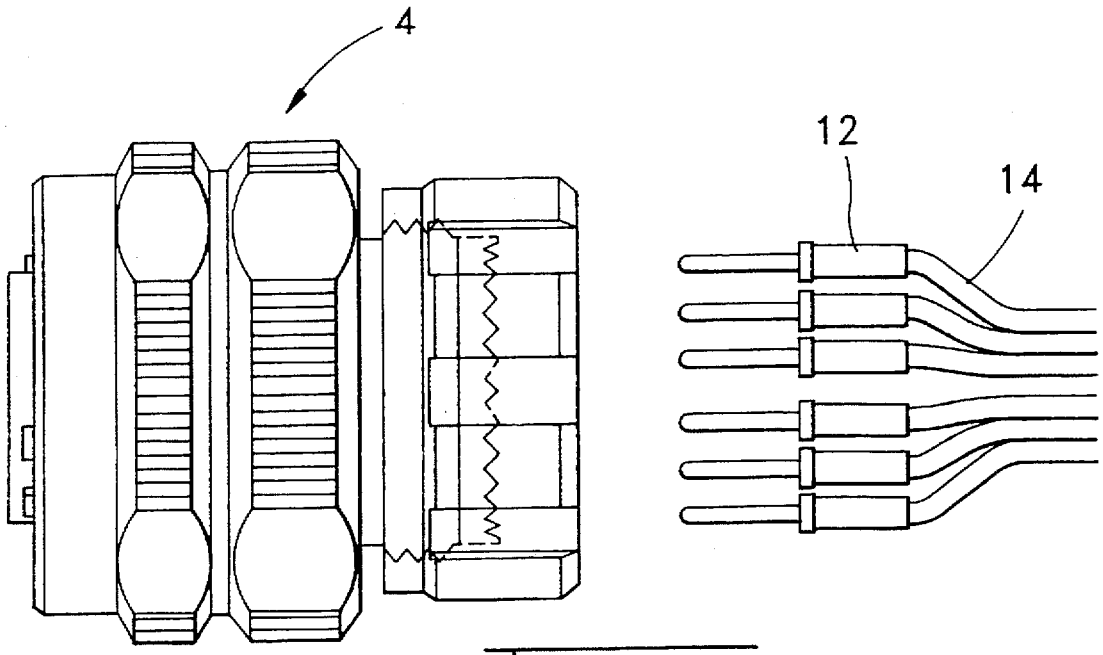
FIG. 3 is a side view of a terminal receiving section of the connector assembly in a partially disassembled state.
Figure 4:
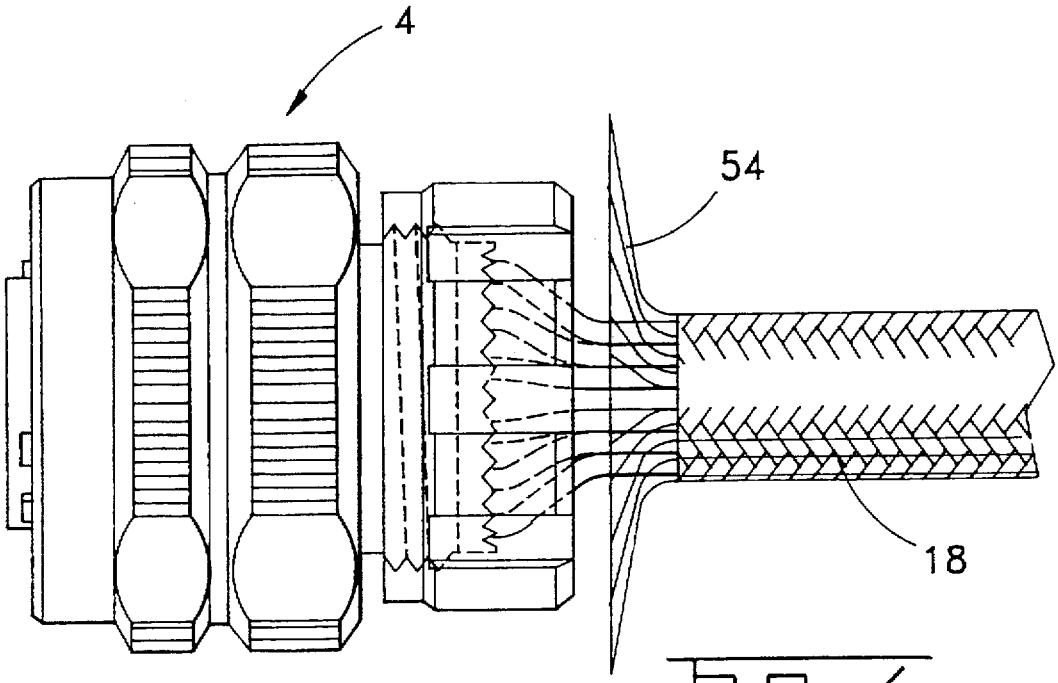
FIG. 4 is a similar view to that of FIG. 3 but with the terminals mounted to the connector.
Figure 5:
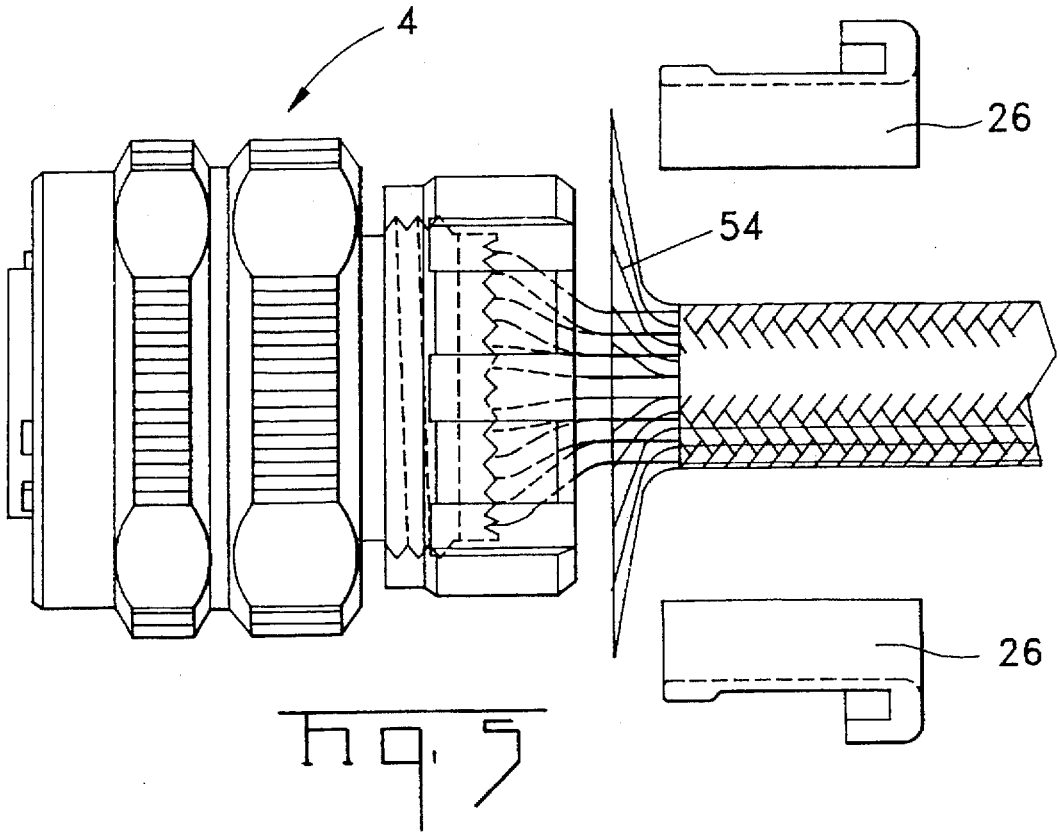
FIG. 5 is a view showing a subsequent step in the assembly procedure with respect to FIG. 4 where shielding braid supports are about to be mounted around the cable.
Figure 6:
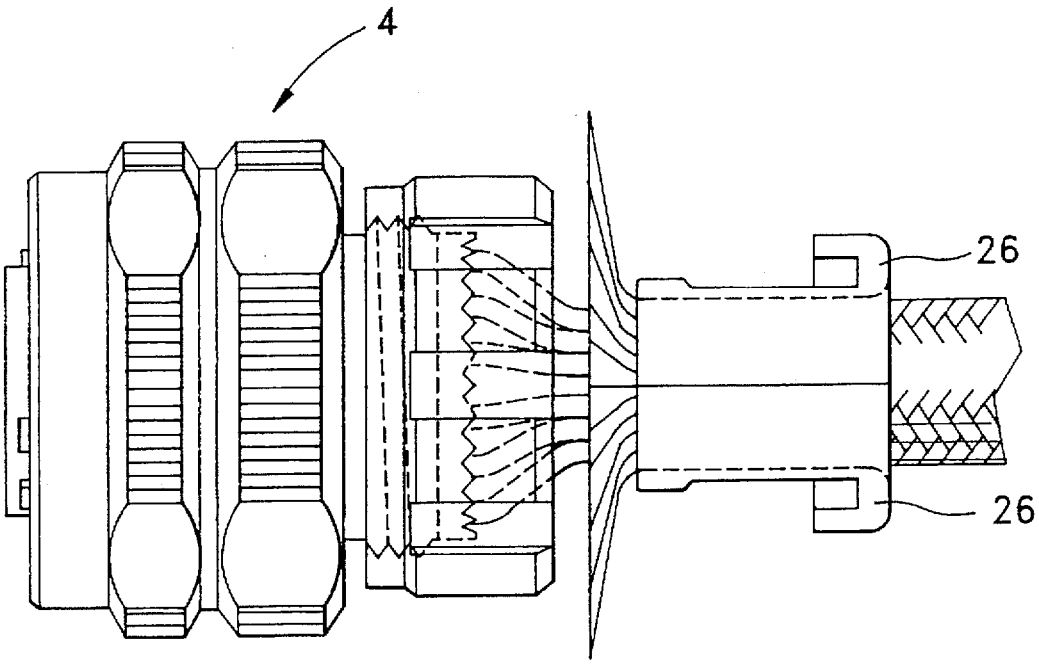
FIG. 6 is a similar view to that of FIG. 5 showing the shielding supports mounted.
Figure 7:
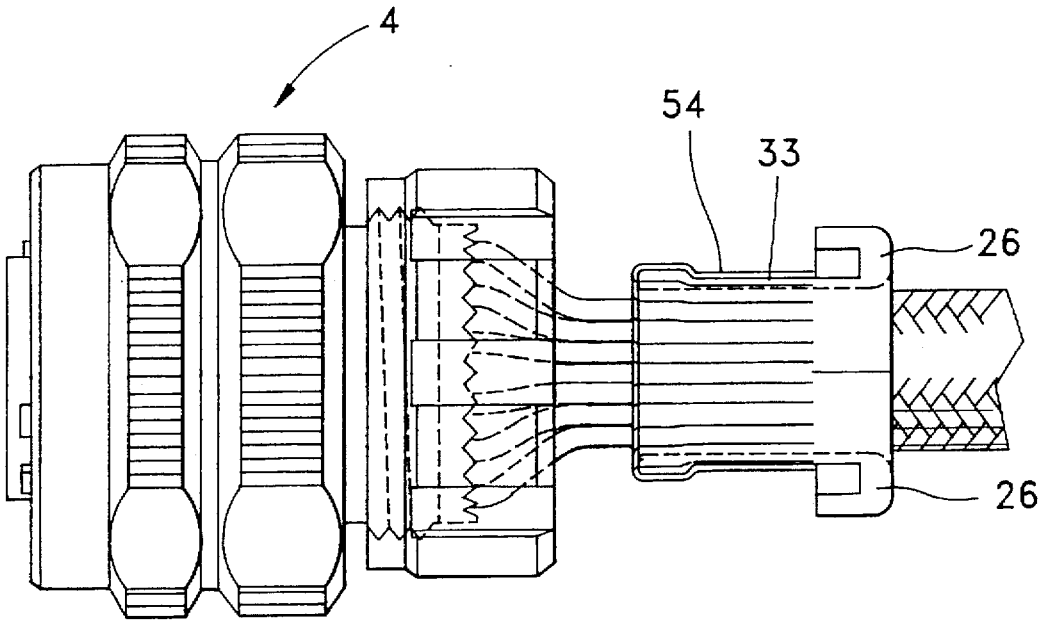
FIG. 7 is a view similar to that of FIG. 6 where the shielding braid is folded back over the support.
Figure 8:
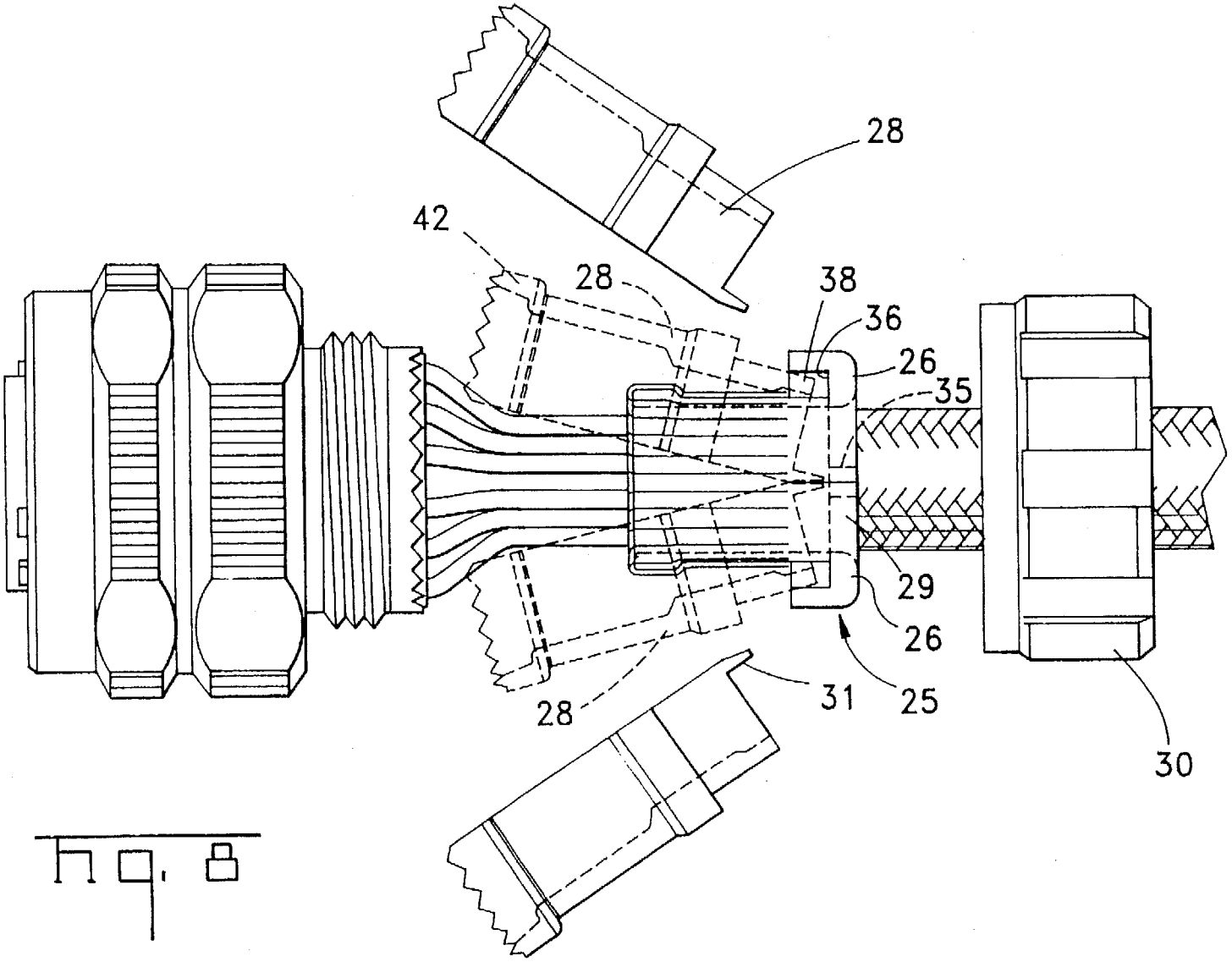
FIG. 8 shows a subsequent step to that of FIG. 7 whereby clamping portions are being mounted to the shielding support.
Figure 9:
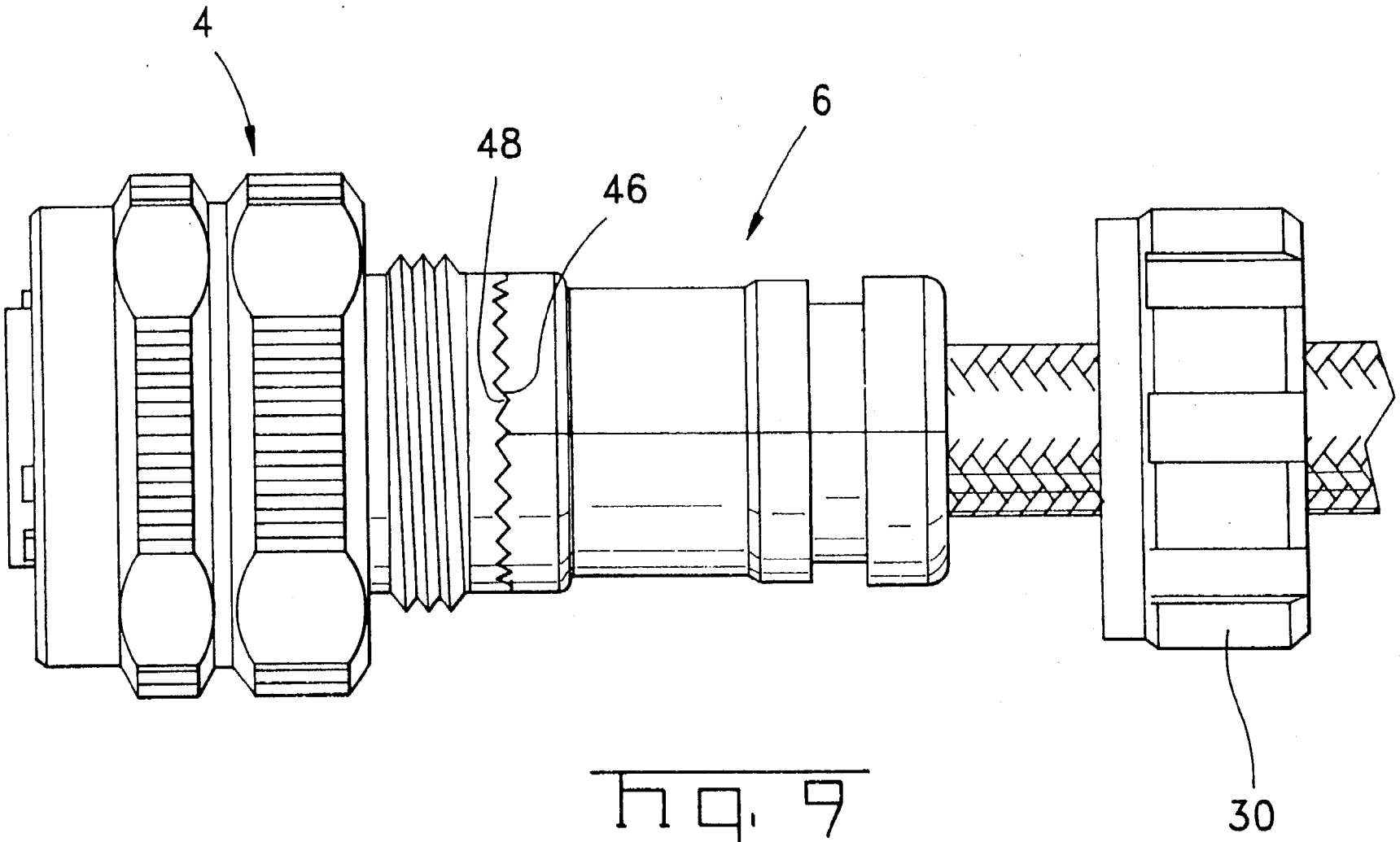
FIG. 9 shows a retention ring about to be mounted over the clamping portions in a subsequent assembly step to that of FIG. 8.

Referring now to FIGS. 3–9, assembly of the connector will now be described. Referring first to FIG. 3, terminals 12 can be initially connected to conducting wires 14 of the cable prior to mounting to any of the connector parts. The latter enables the terminals 12 to be crimped to the conducting wires during preparation of the cable in a semi-automatic, or fully automated manner at a harness manufacturing sight. The terminals 12 can then be inserted into terminal receiving cavities (not shown) of the terminal section 4 as shown in FIG. 4. An end portion 54 of the shielding braid 18 is maintained in surplus as shown in FIG. 4 and the support members 26 (identical halves in this embodiment) are then brought together about the shielding proximate the terminal section 4 as shown in FIGS. 5 and 6. The end portion 54 of the braid is then folded back over the cylindrical portion 33 of the support members 26 as shown in FIG. 7. Referring now to FIG. 8, the clamping members 28 (identical halves in this embodiment) are then brought together over the support members 26, and the pivot ends 38 are engaged in the annular slots 36 of the support members, whereby the terminal section end 42 of the clamping members are outwardly tilted. The clamping members can then be rotated towards each other about their pivot ends 38, whereby the lever arm enables tight clamping of the shielding braid between the clamping members and the support members. Positioning of the clamping halves 28 with respect to the support 25 can be assisted by cooperation of projections 31 of the clamping halves, that engage in cavities 35 extending through the end wall 29 of the support 25. Engagement of the tapered surfaces 40,50 as shown in FIG. 2, ensures correct axial positioning of the clamping members 28 with respect to the support members 26, and tight pinching of the shielding braid therebetween for good shielding interconnection. The tapered shoulders 40,50 and slot 36 also provide axial retention of the clamping members 28 with respect to the support members 26. The retention ring 30 is then moved over the clamping members 28 and threaded to the terminal section 18 whereby the shoulders 44 of the clamping members are engaged by a complementary shoulder of the retention ring 30 for tight clamping to the terminal section 4. The interengaging teeth 46,48 prevent rotation of the cable section with respect to the terminal section.

Figure 10:
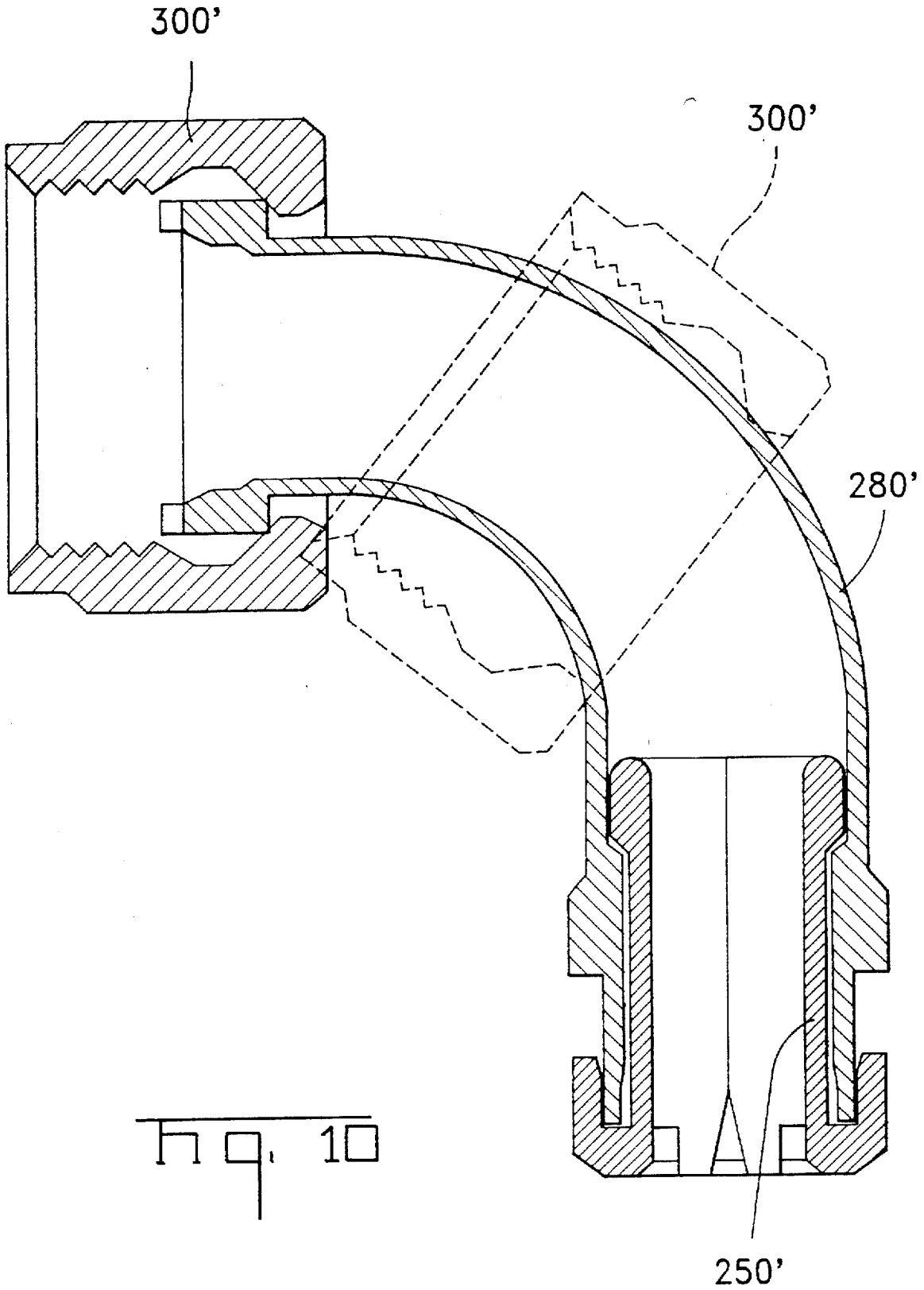
FIG. 10 illustrates in cross-section of part of another embodiment of this invention where the cable outlet is bent through 90°.

Referring to FIG. 10, another embodiment is provided with a locking ring 300' and clamping shells 280' that extend through a 90° bend, which is advantageous for certain applications, due to space requirements. The bend protects the bend in the cable, rather than having a straight outlet and then bending the cable, if a 90° outlet is required. Other outlet angles can of course also be provided. In this embodiment, the clamping shells 280' are also provided as half-shells mountable pivotally against a shield support 250' similar to the shield support 25 described in the first embodiment.

Referring to FIGS. 12–15, another embodiment of a shielded cable connector 502 is shown comprising a terminal section 504 and a cable section 506. This embodiment is similar in many respects with the previously described embodiments, with the major differences being described below. The shield support 525 is also provided into half-shells that fit around the cable 16 and receive the end of the shielding braid 54 folded over a terminal section end of the support, overlaying the body portion 533. Instead of clamping the shielding braid against the body portion 533 by means of the pair of outer clamping members 528, a clamping collar 560 is provided. The clamping collar is for example a supple metal band that is positioned around the support member 525, tightened therearound and securely attached by means of a crimp or deformed tabs. Collars of this type are conventional products.

Figure 13:
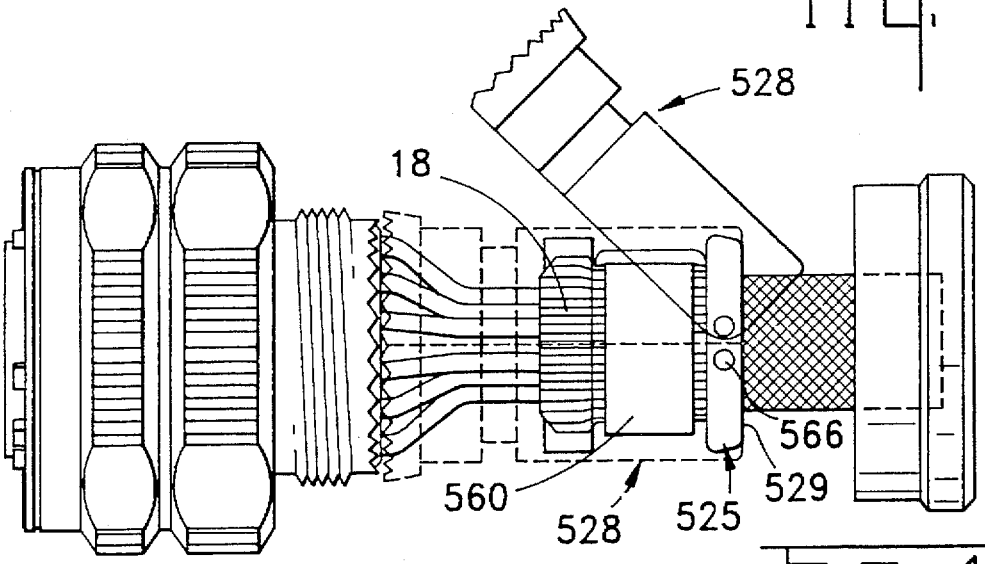
FIG. 13 is a view similar to that of FIG. 12 in a subsequent assembly step.
Figure 14:
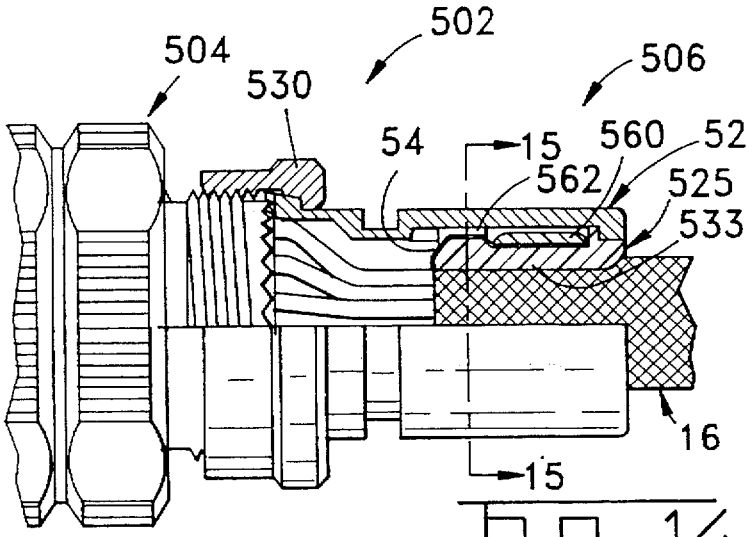
FIG. 14 is a partial cross-sectional view through the embodiment of FIGS. 12 and 13 fully assembled.
Figure 15:
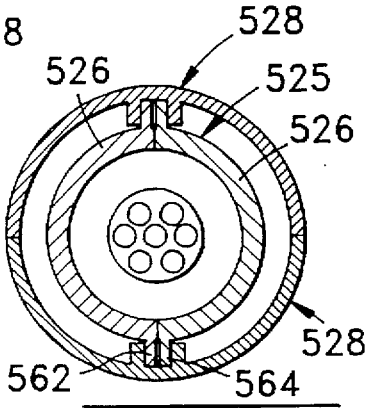
FIG. 15 is a simplified cross-sectional view through lines 15—15 of FIG. 14.

As shown in FIG. 13, the clamping shells 528 can then be pivotally mounted at the cable receiving end 529 of the support 525 and pivoted into the final position. In order to provisionally latch or secure the clamping members 528 in their mounted position, the support member 525 is provided with resilient studs 562 at the terminal section end that engage in an interference fit with corresponding recesses 564 provided on the clamping shell 528. The latter facilitates handling of the partial assembly, whereby the locking ring 30 can then be slipped over the clamping shells 528 to lock the cable section 506 to the terminal section 504. The provision of the clamping collar enables shielding of different thickness to be effectively clamped, whereas in the previous embodiment the range of thicknesses of the shielding braid to be clamped is determined by the gap between the clamping shell and support member.

As can be seen in FIG. 13, it is also possible to provide pivot studs 566 that engage in slots in the clamping shells 528 for pivot mounting thereof. This, would for example, be an alternative for the annular groove in the support member provided in the other embodiments.

Advantageously therefore, terminals can be connected to wires of the cable prior to assembly to parts of the connector, whilst nevertheless enabling mounting of a robust and effective shielding interconnection between the cable and the connector.

We claim:

1. A connector for connection to a shielded cable, the connector comprising a terminal section for assembly of terminals therein, and a cable section for clamping and electrical connection to shielding of the cable, the cable section comprising a support having a body portion mountable around the cable such that shielding thereof can be clamped thereto, wherein the support comprises at least two separate parts that enable mounting to the cable without feeding the cable through the support, and wherein the body portion extends from a terminal section end proximate the terminal section to a cable receiving end remote from the terminal section, and wherein the cable section further comprises a shield clamp having shells extending from a pivot end to a terminal section end, the clamping shells pivot ends pivotally engageable in a member of the support proximate the cable receiving end of the body portion for pivotally mounting around the support body portion.

2. The connector of claim 1 wherein the clamping shells and support are dimensioned so as to clamp the cable shielding therebetween.

3. The cable connector of claim 1 wherein the cable section further comprises a clamping collar for clamping the cable shielding around the support.

4. A connector for connection to a shielded cable, the connector comprising a terminal section for assembly of terminals therein, and a cable section for clamping and electrical connection to shielding of the cable, wherein the cable section comprises a support having a body portion mountable against a shielded section of the cable, the body portion extending from a terminal section end proximate the terminal section and a cable receiving end remote from the terminal section, the cable section further comprising a shield clamp having clamping shells extending from a pivot end to a terminal section end, the clamping shell's pivot ends pivotally engageable in a member of the support proximate the cable receiving end of the body portion for pivotally mounting around and against the support body portion, thereby clamping the cable shielding, the cable section further comprising a locking member for secure attachment to the terminal section.

5. The connector of claim 4 wherein the support is made of at least two separate support members mountable together about the cable.

6. The connector of claim 1 wherein the support has an oblique abutment surface facing outwardly and directed away from the terminal section, the abutment surface cooperable with a complementary abutment surface of the clamping shells.

7. The connector of claim 4 wherein the support and clamping shells are adapted to receive the shielding of the cable therebetween, the shielding being foldable over the terminal section end of the support to extend over the body portion.

8. The connector of claim 5 wherein there are a pair of identical shells forming a generally axi-symmetric shield clamp.

9. The connector of claim 8 wherein there are a pair of identical support members forming a generally axi-symmetric support.

10. The connector of claim 5 wherein the clamping shells have a retention shoulder proximate the terminal section end and engageable by a shoulder of a locking ring for secure attachment to the terminal section.

11. The connector of claim 5 wherein the clamping shells are provided with axial teeth interengageable with axial teeth of a cable section end of the terminal section for preventing relative rotation between the cable and terminal sections.

12. The connector of claim 5 wherein the clamping shells are provided with axially extending projections at their pivot ends for engagement in one or more discrete cavities extending through an end wall of the support, to locate the clamping shells, in the sense of rotation about the cable, with respect to the support.

13. The connector of claim 10 wherein the retention shoulder is engageable by a discrete projection that forms the locking ring shoulder, the discrete projection insertable through an axial groove of the terminal section end, and engageable behind the retention shoulder upon rotation of the locking ring relative to the clamping shells.

14. The connector of claim 13 wherein the retention shoulder is tapered and comprises dimples for seating the projection and preventing unlocking rotation thereof.

15. The connector of claim 5 wherein the clamping shells are bent through an angle for directing the cable outlet at a different angle to the mating direction of the connector.

* * * * *